US005106063A

United States Patent [19]

Granström

[11] Patent Number: 5,106,063

[45] Date of Patent: Apr. 21, 1992

[54] CONTAINER

[75] Inventor: Staffan Granström, Öjebyn, Sweden

[73] Assignee: ESSGE Systemteknik AB, Piteå, Sweden

[21] Appl. No.: 424,318

[22] PCT Filed: Mar. 10, 1989

[86] PCT No.: PCT/SE89/00118

§ 371 Date: Nov. 17, 1989

§ 102(e) Date: Nov. 17, 1989

[87] PCT Pub. No.: WO89/08812

PCT Pub. Date: Sep. 21, 1989

[30] Foreign Application Priority Data

Mar. 17, 1988 [SE] Sweden ..... 8800973

[51] Int. Cl.[5] ..... C21D 1/74

[52] U.S. Cl. ..... 266/249; 266/901

[58] Field of Search ..... 266/901, 249, 274, 275; 432/81

[56] References Cited

U.S. PATENT DOCUMENTS 3,514,279 5/1970 Jensen et al. ..... 266/901
3,771,775 11/1973 Reinbold et al. ..... 266/901
3,852,028 12/1974 Reinbold et al. ..... 266/901
4,028,048 6/1977 Woolworth ..... 432/5
4,395,280 7/1983 Takenouchi et al. ..... 75/28
4,690,638 9/1987 Nakagawa et al. ..... 432/81

FOREIGN PATENT DOCUMENTS 2059029 4/1981 United Kingdom .

*Primary Examiner*—S. Kastler
*Attorney, Agent, or Firm*—Burns, Doane, Swecker & Mathis

[57] ABSTRACT

This invention relates to a container for materials, preferably scrap iron for steel production and intended to be placed on a stand in a preheating station in order that the scrap iron shall be heated up to a high temperature. The container includes an essentially cylindrical upper part and a lower part comprising openable bottom halves. The upper part of the container (1) and each bottom half (4) comprise a gas-tight shell (2;15) and a load-carrying frame-work (5,6,7,8;10,11,12,13) positioned outside the shell (2;15) and functioning as a support for the gastight shell.

30 Claims, 4 Drawing Sheets

CONTAINER

BACKGROUND OF THE INVENTION

This invention relates to a container for materials, preferably scrap iron for steel production and intended to be placed on a stand in a preheating station in order that the scrap iron shall be heated up to a high temperature, and comprising an essentially cylindric upper part and a lower part comprising openable bottom halves.

Scrap iron is usually utilized as a main raw material when producing steel by means of the electric steel method. In this connection as a rule a preheating of the scrap iron is made before it is brought to a furnace for melting. The preheating of the scrap iron being in the container is made in order to save energy and is made by means of flue gases from the furnace in which the scrap iron shall be melted or by means of flue gases from a combustion chamber provided with a burner.

When heating scrap iron the flue gas temperature and the heating time up to now have had to be limited due to the fact that the scrap iron containers do not have such a construction that they are suitable to use if the scrap iron has a high temperature. It is true that the container itself is made of a strong steel plate with thick walls so that it can resist loads in high temperatures, but since the container itself is intended to carry loads, its strength is considerably reduced when scrap iron is heated up to a high temperature by hot gases. An essential reason why the temperature of the container should be high if the scrap iron temperature were high is that the cooling of known containers and the surrounding details is not satisfactory. As a rule this cooling is made by gravity flow of the surrounding air.

SUMMARY OF THE INVENTION

This invention intends to remove the problems with the known technique. This has been achieved by a container of the kind mentioned by way of introduction, which can be used for materials, such as scrap iron, for steel production and which can be placed on a stand in a preheating station in order to heat the scrap iron to a high temperature. The container includes an essentially cylindrical upper part and a lower part comprising openable bottom halves. The container includes a shell for enclosing materials such as scrap iron and a load-carrying framework positioned outside the shell and functioning as a support for the shell. The load-carrying framework comprises means constituting channels for circulating a cooling medium and the bottom halves are cooled by the load-carrying framework.

Due to the fact that the container has been given the above construction, conditions are created for an active cooling of the same by means of gas and/or a liquid. Due to that fact the scrap iron in the container can be heated to a high temperature without any considerable increase of the temperature in the surroundings of the container or in the load-carrying frame-work, whereby the strength of the load-carrying frame-work is not considerably reduced.

BRIEF DESCRIPTION OF THE DRAWINGS

A preferred embodiment of the invention shall be described more closely with reference to the accompanying drawings, in which.

DETAILED DESCRIPTION OF THE PREFERRED EMBODIMENTS

Figure 1:
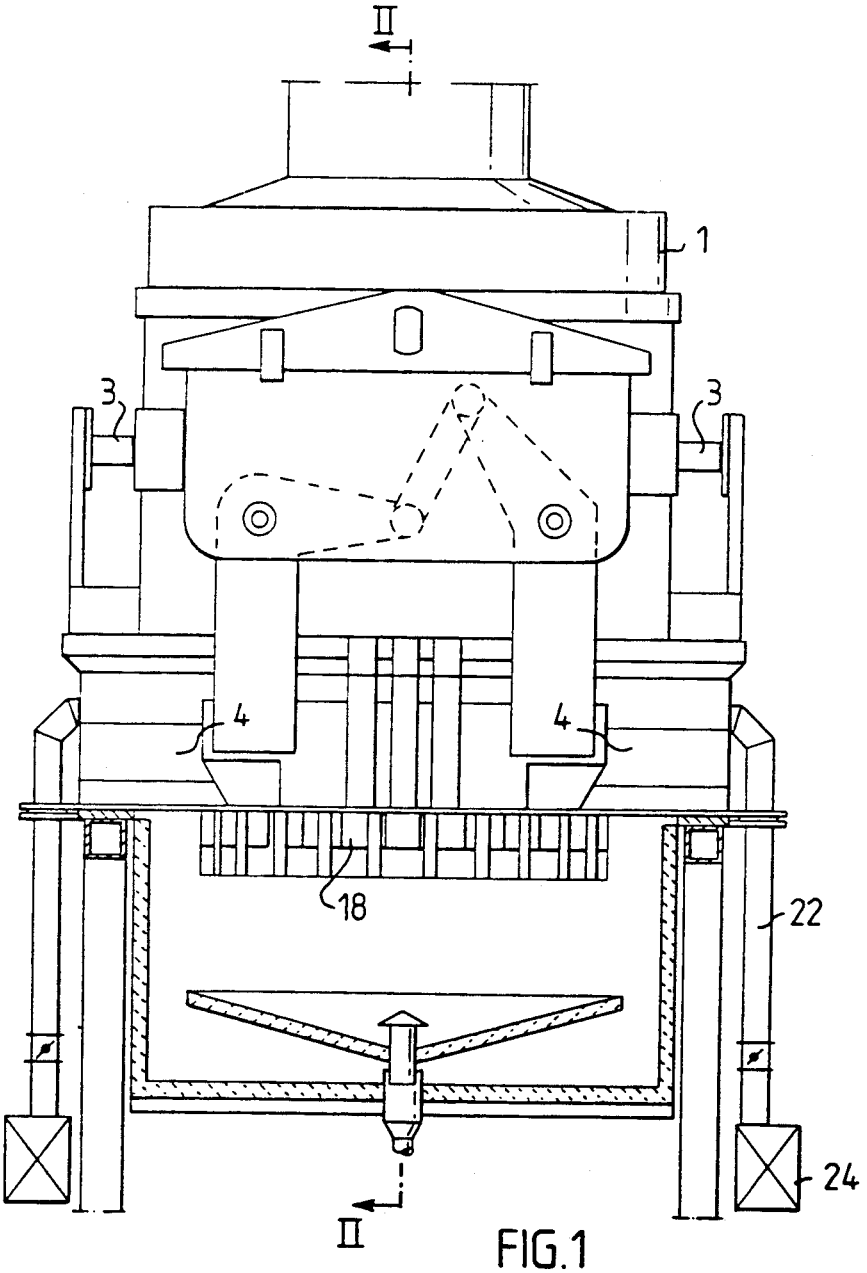
FIG. 1 shows a scrap iron container standing on a s a preheating station.
Figure 2:
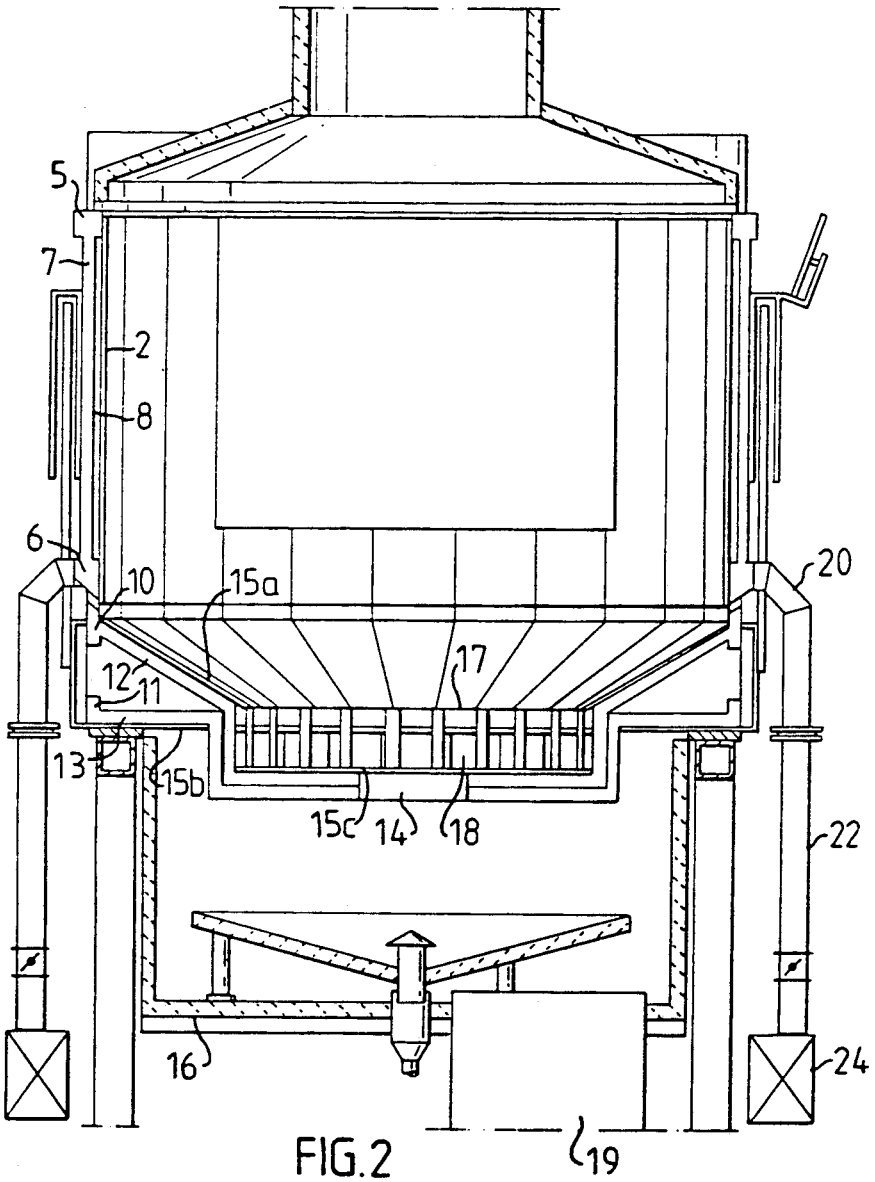
FIG. 2 shows a section of the scrap iron container along the line II—II of FIG. 1.
Figure 3:
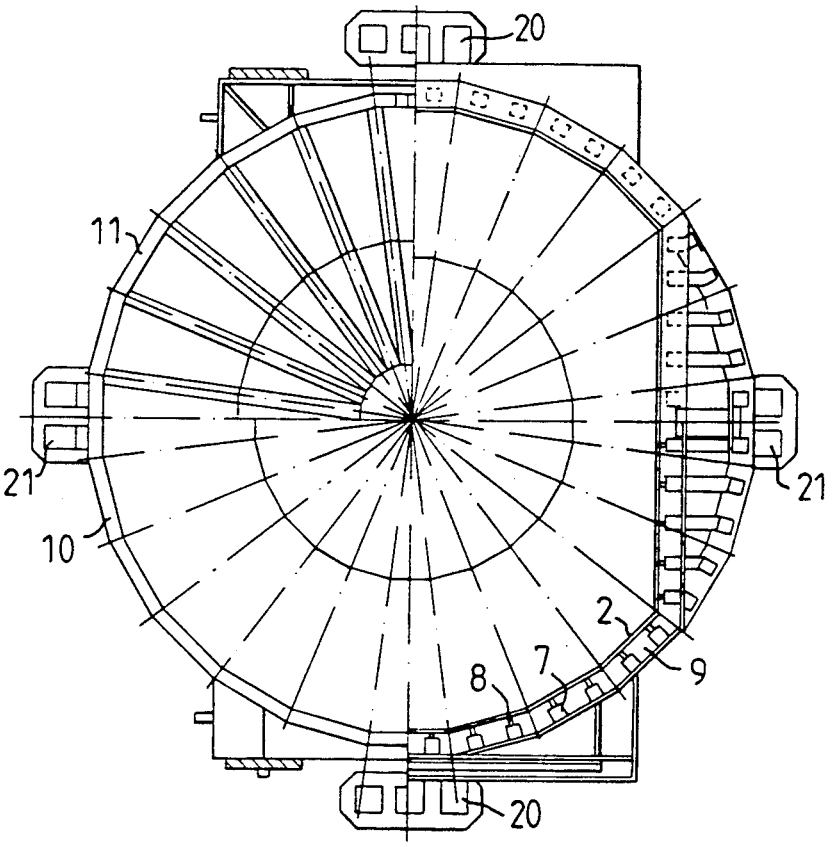
FIG. 3 shows horizontal sections through the scrap iron container on different levels.
Figure 4A:
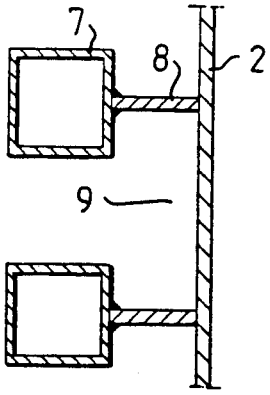
FIGS. 4A and 4B show pictures of the container wall and adjacent parts.
Figure 4B:
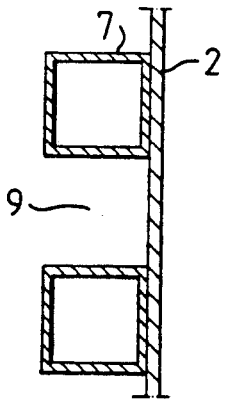

In FIGS. 1-3 is shown a scrap iron container 1 having an essentially cylindrical, gas-tight shell 2 of a steel, which is resistant to high temperatures, and two projecting lifting taps 3 at its upper half for connection with a lift device. At its lower part the scrap iron container is provided with two bottom-halves 4, intended to be opened when the heated scrap iron shall be charged from the container. According to the invention the cylindrical shell 2 of this container can be made thinner than in known containers. For instance, the shell 2 can consist of a single metal plate as shown in FIGS. 4A and 4B. The primary purpose of the shell 2 is to keep the scrap iron in place during the heating. Due to the fact that the shell has been made thin, it has to be supported by a load-carrying frame-work. Thus, the container is provided with an outer load-carrying frame-work comprising an upper 5 and a lower 6 tubular collecting and distribution girder and other tubular connecting girders 7 and supporting bars 8. Therewith, both collecting and distribution girders 5,6 surround the shell 2 and are connected with each other by means of the girders 7 and the supporting bars 8, which are essentially vertically arranged in a great number and circumferentially spaced apart around the shell 2 at an angular distance to each other. The load-carrying parts 5,6,7 of the frame-work also have the purpose to function as channels for a cooling medium, whereby not only the load-carrying parts but also the jacket of the cylindrical shell 2 can be cooled.

In FIG. **4*a* and 4*b* there are shown two alternative embodiments regarding the relation between the shell 2 and the vertical channel 7 of.,cooling medium. In the embodiment according to FIG. 4A the channel 7 of cooling medium is connected with the shell 2 by means of the vertical supporting bar 8. When having this embodiment it could be suitable to place an isolation heat barrier in the space 9 between the shell 2 and the channel 7, whereby the heat losses are reduced and the radiation of heat from the shell 2** to its surroundings is prevented.

In the embodiment according to FIG. 4B the supporting bars 8 are taken away. In this case the tubular girders 7 constituting the channels of cooling medium function as a support for the shell 2 and rest directly against the shell. Due to that fact the shell can be cooled down by means of the cooling medium streaming or circulating in the tubular girder 7.

The lower part of the container 1, i.e. the bottom halves 4, is also intended to be cooled by a cooling medium and to be supported by a frame-work. For this purpose the two bottom halves 4 comprise an upper 10 and a lower 11 half-circular and tubular, collecting and distribution girder. Both girders 10,11 surround the shell 15 and are connected with each other by upper 12 and lower 13 connecting tubular girders and a centre box 14 The girders 12,13 are arranged so as to be circumferentially spaced apart around the shell 15 at an angular distance from each other. The side inner jacket 15*a* and the lower inner jacket 15*c*, of the bottom halves 4 are intended to rest on the upper girder 12 and the centre box 14, respectively. Under the lower girder 13, which is intended to function as a channel for a cooling medium, there is arranged a supporting plate 15*b* constituting the support for the container 1 when it rests against a container stand 16 during the heating period.

Between the inner jacket 17 of the container at its lower part and the upper girder 12 there are arranged a number of channels 18 through which a hot gas is intended to stream for heating the scrap iron in the container 1. This gas passes out through the outlet channel 19 in the container stand 16 after having passed the channels 18.

The cooling medium is supplied to and removed from the collecting and distributing girders 5,6 at the cylindrical part and the collecting and distributing girders 10,11 at the lower part of the container, respectively, by means of connecting pipes 20 and 21, respectively. For this reason there are two connections at the container 1 for both the pipe 20 and the pipe 21. The angular distance between ,the pipe connections 20 and 21 is essentially 90° (see FIG. 3).

The connecting pipes 20 and 21 are intended to be automatically connected with pipes 22 of cooling medium when the container 1 is placed in the container stand 16.

Figure 5:
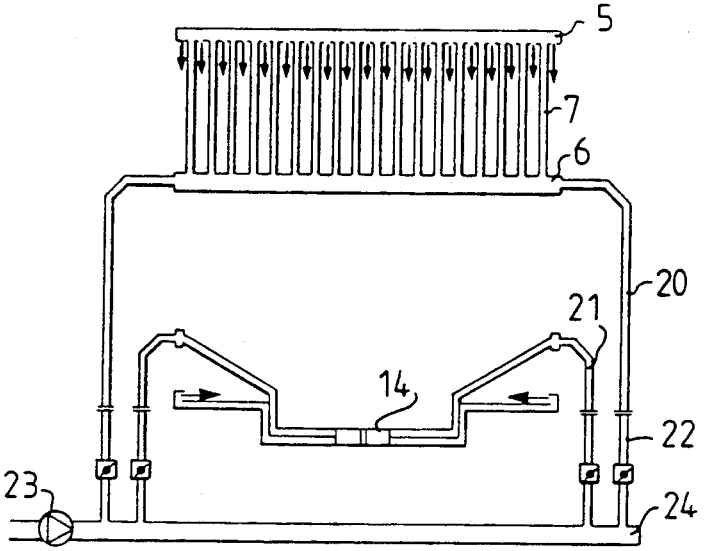
FIG. 5 shows a principle diagram for cooling the container by a gas, for instance air.
Figure 6:
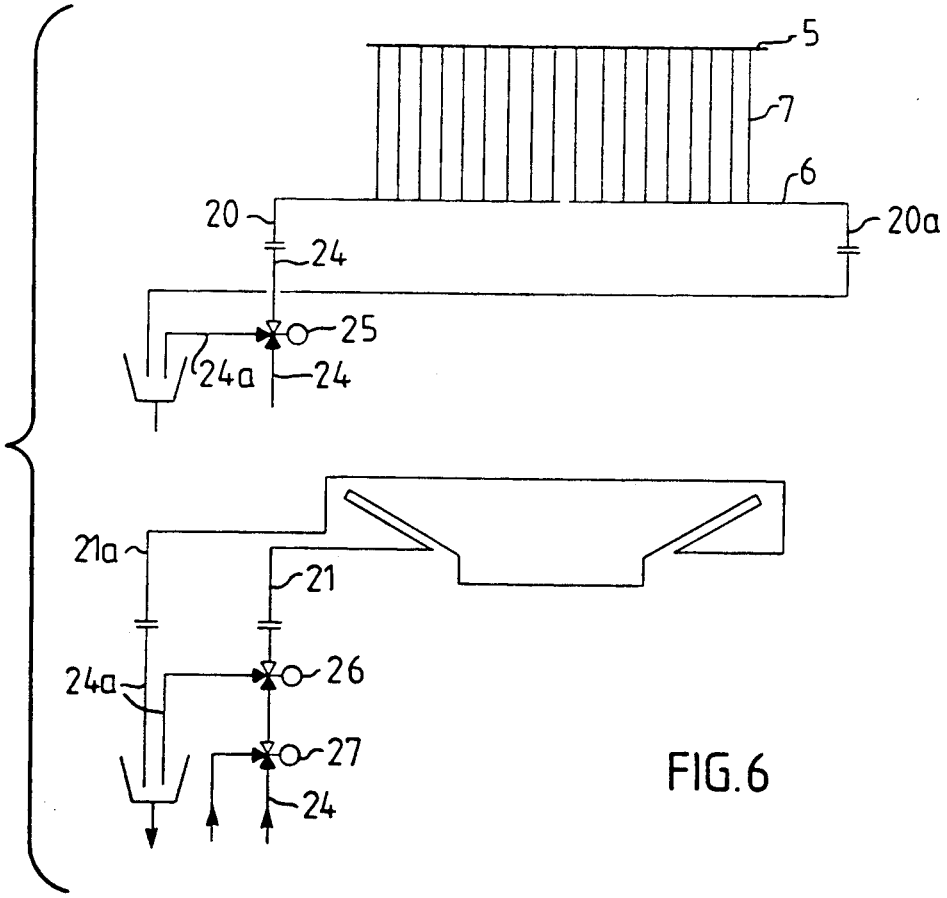
FIG. 6 shows a principle diagram for cooling the container by a liquid, for instance water.

The container 1 can be cooled either by air and/or water as a cooling medium (see particularly FIGS. 5,6). When using air, it is blown by a fan via the distribution channels 24,22,21,20 to the distribution girders 5 or 6 and 10 or 11, respectively, on the container 1, whereafter the air is transported through the tubular girders 7 and 12,13,14, respectively, to the other distribution girders, in which holes for outlet of the air are directed to the inner jacket 2 of the cylindrical part and to the inner jacket 15*a* the bottom halves 4 and the supporting plate 15*b* at the lower part of the container. After the passage through the outlet holes in the distribution girders, the air is blown along the inner jacket and cools the same.

In this way a direct cooling of the lower part of the container and the load-carrying parts of the cylindrical part is achieved and also a directed cooling of the inner jackets of the container 1.

When having water as a cooling medium it is supplied via inlet pipes 24,20 and a three-way valve 25 to either the lower 6 or the upper 5 distribution girder of the cylindrical part, whereafter the water is distributed through the tubular girders 7 to the second distribution girder and via the return pipes 20*a* and 24*a* to a waste hopper in a cooling water system. When shifting the three-way valve 25, the cooling water circuits are automatically emptied.

The supply of cooling medium to the lower distribution girder 11 of respective bottom half 4 is made via the inlet pipes 24,21 and three-way valves 26,27. The cooling medium thereafter passes the tubular girders 13,12 to the upper distribution girder 10 and then via the return pipes 21*a*, 24*a* to a waste hopper in the open cooling water system.

When shifting the three-way valve 26, the upper parts of the cooling water circuits for respective bottom half 4 are automatically emptied. When shifting the three-way valves 26,27, the lower parts of the cooling water systems also are emptied by means of the pressurized air being let into the system via the conduit 20 and the three-way valve 27.

In the description tubular girders have been mentioned. With tubular girders is meant tubular girders having circular, square, rectangular or another cross section.

The invention is of course not limited to the mentioned embodiments but can be modified within the scope of the following claims.

I claim:

1. A container for materials including scrap iron for steel production and which can be placed on a stand in a preheating station so that the scrap iron can be heated up to a high temperature, and comprising an essentially cylindrical upper part and a lower part comprising openable bottom halves, the container comprising a shell (2) for enclosing the material, and a load-carrying frame work (5–8; 10–13) positioned outside the shell (2) and functioning as a support for the shell (2), the load-carrying frame work comprising means (5, 6, 7) constituting channels for a cooling medium, and wherein the bottom halves (4) are cooled by the load-carrying frame work (10–14), through which a cooling medium can be passed.

2. Container according the claim 1, wherein the load-carrying frame-work in the cylindrical upper part comprises an upper (5) and a lower (6) tubular collecting and distribution girder, surrounding the shell (2) and connected with each other by tubular girders (7), arranged essentially vertically round the shell (2) in an angle distance to each other.

3. A container according the claim 2, wherein the contact surface between the load-carrying frame-work in the cylindrical, upper part and the inner shell (2) consists of the girders (7).

4. A container according to claim 2, wherein essentially vertical supporting bars (8) are arranged edgeways between the upper girder (5) and the lower girder (6) and constituting contact element between the vertical girders (7) and the inner shell (2).

5. A container according to claim 2, wherein a heat barrier is placed in the space between the girder (7) and the inner shell (2).

6. A container according to claim 1, wherein the load-carrying frame-work in respective bottomhalf (4) comprises an upper 10 and a lower 11 tubular collecting and distribution girder, surrounding the shell (15) and connected with each other by upper (12) and lower (13) tubular girders and a centre box (14), the girders (12,13) being arranged around the shell (15) in an angle distance to each other.

7. A container according to claim 6, wherein the inner jackets (15*a, c*) of the bottom halves (4) rest against the upper girders (12) and the centre box (14), and a supporting plate means (15*b*) is arranged under the lower girders (13) for supporting the container (1) when the container rests on a container stand (16).

8. A container according to claim 6, wherein the container includes means for passing a cooling medium in the form of gas or a liquid through the channels formed by the tubular girders (5,6,7,10,11,12,13) and the centre box (14), for cooling the container (1) and its surroundings.

9. A container according to claim 8, wherein the container includes means for blowing a cooling medium in the form of gas, after passage of the channels, towards the outside of the gastight shell (2) and (15*a*, 15*b*), respectively, through holes in the girders (5,6,7,10,11,12,13) for cooling thereof.

10. A container according to claim 6, wherein channel means (18) is arranged between the inner jacket (17) of the container at its lower part and the upper girder (12) for passing a hot gas to heat the material in the container.

11. A container according to claim 3, wherein a heat barrier is placed in the space between the girder (7) and the inner shell (2).

12. A container according to claim 4, wherein a heat barrier is placed in the space between the girder (7) and the inner shell (2).

13. A container according to claim 7, wherein the container includes means for passing a cooling medium in the form of gas or a liquid through the channels, formed by the tubular girders (5,6,7,10,11,12,13) and the centre box (14), for cooling the container (1) and its surroundings.

14. A container according to claim 7, wherein channel means (18) is arranged between the inner jacket (17) of the container at its lower part and the upper girder (12) for passing a hot gas to heat the material in the container.

15. A container according to claim 8 wherein channel means (18) is arranged between the inner jacket (17) of the container at its lower part and the upper girder (12) for passing a hot gas to heat the material in the container.

16. A container according to claim 9, wherein channel means (18) is arranged between the inner jacket (17) of the container at its lower part and the upper girder (12) for passing a hot gas to heat the material in the container.

17. A container suitable for preheating materials including scrap iron used for steel production, comprising:

upper and lower parts, the upper part comprising a shell for enclosing material and the lower part comprising first and second openable bottom halves for discharging the material from the container; and a load carrying framework surrounding and supporting the shell and surrounding and supporting the first and second openable bottom halves, the framework including circulating means for circulating a cooling medium within the framework so that the upper and lower parts of the container are cooled when the material in the container is heated and a cooling medium is circulated within the framework.

18. The container of claim 17, wherein the circulating means comprises interconnected tubular members which form the framework, the tubular members including vertically spaced-apart upper and lower distribution girders surrounding the shell and spaced-apart vertically extending connecting girders in fluid communication with the upper and lower distribution girders.

19. The container of claim 18, wherein the connecting girders are in contact with an outer surface of the shell.

20. The container of claim 19, wherein the shell is substantially cylindrical in shape and consists of a single metal plate, the metal plate having an outer surface thereof in contact with the connecting girders.

21. The container of claim 18, wherein the connecting girders are spaced from an outer surface of the shell by vertically extending supporting bars, each of the supporting bars extending between a respective one of the connecting girders and the outer surface of the shell.

22. The container of claim 21, wherein each of the supporting bars comprises a flat plate having one edge thereof in contact with a respective one of the connecting girders and an opposite edge thereof in contact with the shell.

23. The container of claim 18, further comprising heat barrier means located in spaces between the connecting girders and the shell.

24. The container of claim 17, wherein the circulating means comprises interconnected tubular members which form the framework, the tubular members including vertically spaced-apart upper and lower distribution girders surrounding the lower part of the container and spaced-apart vertically extending connecting girders in fluid communication with the upper and lower distribution girders.

25. The container of claim 17, wherein the circulating means comprises interconnected tubular members which form the framework, the tubular members including:

vertically spaced-apart first upper and lower distribution girders surrounding the first openable bottom halve of the shell and spaced-apart first connecting girders in fluid communication with the first upper and lower distribution girders; and vertically spaced-apart second upper and lower distribution girders surrounding the second openable bottom halve of the shell and spaced-apart second connecting girders in fluid communication with the second upper and lower distribution girders.

26. The container of claim 25, wherein the container includes a supporting plate means on the lower part of the shell for supporting the container on a container stand when the material in the container is heated, the first connecting girders including upper connecting girders supporting side and lower inner jackets of the first operable bottom halve, lower connecting girders located above the supporting plate means, and a centre box in fluid communication with the upper and lower connecting girders.

27. The container of claim 18, wherein the girders include holes therein permitting passage of the cooling medium outwardly from the girders and in contact with an outer surface of the shell.

28. The container of claim 24, wherein the girders include holes therein permitting passage of the cooling medium outwardly from the girders and in contact with an outer surface of the shell.

29. The container of claim 25, wherein the girders include holes therein permitting passage of the cooling medium outwardly from the girders and in contact with an outer surface of the shell.

30. The container of claim 17, wherein the container includes channel means through an inner jacket of the container at the lower part thereof for passing a hot gas into the container for heating the material enclosed within the shell.

* * * * *